US005390850A

United States Patent [19]

Rosenberg

[11] Patent Number: 5,390,850

[45] Date of Patent: Feb. 21, 1995

[54] HIGH-FREQUENCY FLUID PULSATOR

[76] Inventor: Peretz Rosenberg, 30 046, Moshav Beit Shearim, Israel

[21] Appl. No.: 138,285

[22] Filed: Oct. 20, 1993

[30] Foreign Application Priority Data

Oct. 28, 1992 [IL] Israel ..... 103576

[51] Int. Cl.[6] ..... B05B 1/08

[52] U.S. Cl. ..... 239/99

[58] Field of Search ..... 239/542, 99, 101

[56] References Cited

U.S. PATENT DOCUMENTS

| | | | |
|---|---|---|---|
| 3,739,983 | 6/1973 | Jousson . | |
| 4,014,473 | 3/1977 | Rosenberg | 239/542 |
| 4,232,711 | 11/1980 | Ray, Sr. et al. . | |
| 4,760,957 | 8/1988 | Rosenberg . | |
| 4,796,810 | 1/1989 | Zakai . | |

FOREIGN PATENT DOCUMENTS

| | | | |
|---|---|---|---|
| 436502 | 11/1926 | Germany | 239/99 |
| 1069725 | 1/1984 | U.S.S.R. | 239/99 |
| 1123592 | 11/1984 | U.S.S.R. | 239/99 |
| 1509002 | 9/1989 | U.S.S.R. | 239/542 |

*Primary Examiner*—Andres Kashnikow
*Assistant Examiner*—Kevin Weldon
*Attorney, Agent, or Firm*—Benjamin J. Barish

[57] ABSTRACT

A fluid-flow control device includes an oscillating member freely movable within a housing and havng one face movable into and out of contact with an inner face of the housing through which an inlet opening extends to close and open the inlet opening. The contacting faces of the oscillating member and housing are configured such as to set the oscillating member into rapid oscillation opening and closing the inlet opening and to drive the fluid, in the form of high-frequency pulses, out through an outlet opening formed in the opposite face of the housing.

19 Claims, 2 Drawing Sheets

HIGH-FREQUENCY FLUID PULSATOR

FIELD AND BACKGROUND OF THE INVENTION

The present invention relates to fluid-flow control devices, and particularly to a device which can serve as a high-frequency fluid pulsator. The invention is particularly useful for providing high-frequency fluid pulses to a water sprinkler, and is therefore described below with respect to such an application; but it will be appreciated that the invention could advantageously be used in many other applications as well, for example in showerheads, nebulizers, and the like.

One type of fluid-flow control device that has gained widespread use in drip irrigation comprises a housing having an inlet opening extending through an inner face of the housing and connectible to a source of pressurized fluid, and an outlet opening extending from an inner face of the housing for discharging the fluid from the housing; and an oscillating member freely movable within the housing and having one face movable into and out of contact with the inner face of the housing through which the inlet opening extends to close and open the inlet opening. The contacting faces of the oscillating member and housing are configured such as to set the oscillating member into rapid oscillation opening and closing the inlet opening when the inlet opening is connected to a source of pressurized fluid. The device further includes spacing means spacing the oscillating member from the inner face of the housing formed with the outlet opening so as to prevent the oscillating member from closing the outlet opening.

Examples of such devices are described in my Israel Patent 47455 and U.S. Pat. No. 4,014,473. As described in those patents, the oscillating member is effective to reduce the flow of the fluid so as to make the device suitable as a dripper nozzle for drip irrigation purposes.

I have now found that such devices, with relatively minor modifications, can also serve as a high-frequency fluid pulsator for many diverse applications, including water sprinklers, showerheads, nebulizers, and the like.

BRIEF SUMMARY OF THE INVENTION

According to the present invention, there is provided a fluid-flow control device as briefly described above, but characterized in that the outlet opening is formed in the opposite side of the housing, in axial alignment with the inlet opening, and is cooperable with the opposite face of the oscillating member such that the rapid oscillations of the oscillating member drive the fluid out of the outlet opening in the form of high-frequency pulses.

By controlling various parameters in the device, particularly the inlet pressure, the device can be made to pulsate at a relatively high-frequency, from a few pulses per second to many hundreds and thousands of pulses per second.

I have found that such a pulsator, when used with water irrigation sprinklers, increases the range of the water sprinklers very substantially, up to about fifty percent, as compared to conventional sprinklers supplied at the same flow rate. Moreover, I have found that such sprinkers supplied with high-frequency pulses can use larger orifices for the same flow rates, thereby substantially reducing the clogging problem and permitting the use of lower grade (dirtier) water. I have also found that such sprinklers supplied by high-frequency pulses are characterized by better flow regulation as compared to conventional sprinkers, i.e., there are smaller variations in flow outputs with variations in line pressure, as compared to conventional sprinklers.

While the invention is particularly useful with respect to water sprinklers, it could be used in many other applications, for example showerheads, nebulizers, etc.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
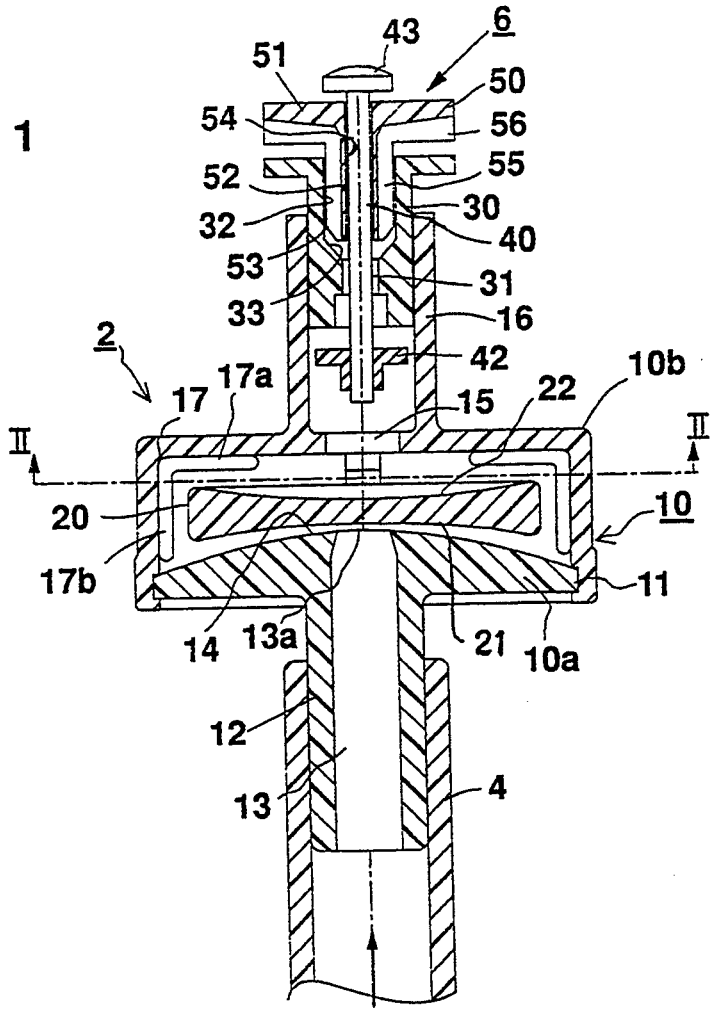
FIG. 1 is a longitudinal sectional view illustrating one form of high-frequency pulsator constructed in accordance with the present invention as used with a known-type water sprinkler.

With reference first to FIG. 1, there is illustrated a pulsator unit, generally designated 2, connected to a source of pressurized fluid, in this case water, supplied by a pipe 4. The pulsator 2 continuously receives the pressurized water from pipe 4 and outputs the water in the form of high-frequency pulses to a rotary sprinkler 6 which distributes the water laterally around the sprinkler.

Pulsator unit 2 superfically resembles the oscillating-type dripper heretofore used in drip irrigation as described in the above-cited patents. In such drippers, an oscillating member in the unit serves to reduce the flow of the water so that the water is discharged at substantially atmospheric pressure in the form of a slow trickle. In this case, however, unit 2 is modified in certain important respects, as will be described more particularly below, to make it operate as a high-frequency pulsator for applying high-energy pulses of the water to the rotary sprinkler 6, which thereby substantially increases the range of the sprinkler for the same output rate.

The pulsator unit 2 includes a housing 10 formed of two sections 10*a*, and 10*b* assembled together by snap-fitting section 10*a* in an annular recess 11 formed in the inner face of housing section 10*b*. Housing section 10*a* is integrally formed with a tubular coupling 12 coupleable to the supply pipe 4 and formed with an inlet opening 13 for feeding the pressurized water into the interior of the housing. The inner face 14 of housing section 10*a* is of convex configuration. The end of the inlet opening 13 extending through convex face 14 is slightly reduced in diameter as shown at 13*a*.

Housing section 10*b* includes an outlet opening 15 circumscribed by a tubular coupling 16 integrally formed with the housing section for coupling the pulsator to the rotary sprinkler 6. Outlet opening 15 and its tubular coupling 16 are in axial alignment with inlet opening 13 and its tubular coupling 12. The inner surface of housing section 10*b* is formed with a plurality (four in this case) spacer ribs 17, of L-shaped configuration, each including a leg 17*a* extending radially with respect to the outlet opening 15, and a leg 17*b* extending axially with respect to that opening.

A thin imperforate disc 20 is disposed within housing 10 and is freely movable therein. The opposite faces 21, 22 of disc 20 are of concave configuration. Face 21 is formed with a radius of curvature slightly larger than that of the convex face 14 of housing section 10*a* such that the two faces 21 and 14 diverge away from each other from the inlet opening 13*a*. Concave face 22 on the opposite side of disc 20 is preferably of the same configuration as concave face 21 so that the disc 20 may be inserted with either face facing the inlet opening 13 when assembling the pulsator.

Disc 20 is of an overall thickness to permit axial oscillatory movement of the disc toward and away from the end 13*a* from the inlet opening 13. During the oscillations of the disc, its face 21 moves into and out of contact with the inner convex face 14 of housing section 10*a*, to close and open the inlet opening 13.

The radially-extending legs 17*a* of ribs 17 are engageable by the opposite face 22 of the disc 20 to space the disc from the respective inner face of housing section 10*b*, and thereby prevent the disc from closing the outlet opening 15. The axially-extending legs 17*b* of the ribs 17 are engageable by the outer periphery of the disc 20 to thereby maintain a continuous flow between the opposite faces of the disc, and thereby a continuous flow of the water through the housing to the outlet opening 15.

The illustrated pulsator 10 operates as follows:

When the tubular connector 12 is connected to the supply line 4, the pressurized water flows through the inlet opening 13 and impinges the concave face 21 of disc 20 to move the disc away from end 13*a* of the inlet opening. Because of the difference in the radii of curvature between the concave face 21 of disc 20, and the convex face 14 of the housing section 10*a*, a pressure gradient is produced between these two faces which tends to draw disc 20 towards and into contact with the convex face 14 of housing section 10*a*, thereby reclosing the end 13*a* of the inlet opening 13. When inlet opening 13 is thus closed, the pressure of the water in the inlet opening 13 again moves the disc 20 away from end 13*a* of the inlet opening. The disc 20 is thus set into rapid oscillation, with concave face 21 of the disc rapidly closing and opening the inlet opening 13. This rapid oscillation of disc 20 causes its opposite concave face 22 to drive the water out of the outlet opening 15 in the form of high-frequency pulses.

The high-frequency water pulses discharged from the outlet opening 15 of the pulsator 10 are applied to the inlet of sprinkler 6. Sprinkler 6 can be of any conventional construction. For purposes of example, it is shown as being of the construction described in my Israel Patent 69302 and U.S. Pat. No. 4,583,689. Such a rotary sprinkler includes three main parts, namely: a nozzle 30 connectible to the tubular connector 16 of the pulsator device 10, and having an axial bore 31 for discharging the water in the form of a jet; a spindle 40 of smaller diameter than the nozzle bore; and a rotor 50 floatingly mounted on the spindle for rotory and axial movement. Spindle 40 includes an inner stop 42 for limiting the axial movement of the spindle in nozzle bore 31, and an outer stop 43 for limiting the axial movement of the rotor with respect to the spindle.

As described in the above-cited patents, rotor 50 is formed with an outer head 51 and a depending stem 52. Stem 52 is rotatably received within a socket 32 in the nozzle 30, and its lower end 53 is tapered, corresponding to the tapered bottom wall 33 of the nozzle socket. Rotor 50 includes an axial bore 54 extending through its stem 52 and its head 51, which bore is of slightly larger diameter than the outer diameter of spindle 40. Rotor stem 52 further includes two axially-extending grooves 55 communicating at their upper ends with two radially-extending grooves 56, such that when pressurized water is applied to nozzle 30, the water flows through these grooves 55 and 56 to lift the rotor against stop 43 of stem 40, and to rotate the rotor, thereby distributing the water laterally of the sprinkler.

Reference may be had to the above-cited patents for further details of the construction and operation of rotary sprinkler 6.

Figure 2:
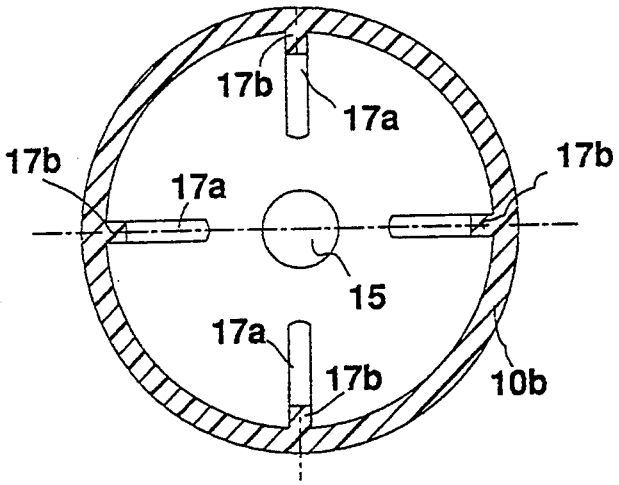
FIG. 2 is a sectional view along line II—II of FIG. 1.

One important characteristic of the illustrated combined pulsator-sprinkler illustrated in FIGS. 1 and 2 is that the cross-sectional area of the inlet passage of the sprinkler 6 (i.e., the cross-sectional area of bore 31 is less than that of stem 40) is substantially smaller than the cross-sectional area of the pulsator outlet 15. Another important characteristic is that the cross-sectional area of the pulsator inlet opening 13, particularly its end 13*a*, is smaller than the cross-sectional area of both the pulsator outlet opening 15 and of the inlet passage of the water sprinkler 6.

As one example, end 13*a* of the inlet opening 13 is from 1 to 2 mm in diameter, the pulsator outlet opening 15 is at least 3 mm in diameter; and the cross-sectional area of annular inlet passage (i.e., the cross-sectional area of bore 31, less that of stem 40) is about 0.8 $mm^2$. The output of such a sprinkler varies from about 8 to 30 liters/hour with a variation of the inlet pressure from 1 to 6 bars. On the other hand, without the pulsator device 10 attached to the rotary sprinkler 6 so that the sprinkler is supplied continuously with the pressurized water, the output of the sprinkler would be up to about 50 liters/hour. It has been found that the range produced by the sprinkler when including the pulsator 10 and having an output of 8 to 30 liters/hour (depending on the inlet pressure and opening 13) would be approximately the same as the range produced by the rotary sprinkler operating in a continuous manner and outputting up to 50 liters per hour.

It will thus be seen that the pulsator 10 illustrated in FIGS. 1 and 2 of the drawings is effective to convert the inletted pressurized water to high-frequency pulses. The frequency of such pulses may vary widely depending on the parameters of the device and the inlet pressure applied. For example, a pulsator constructed as described above, and supplied with an inlet pressure of 1 or 2 bars, oscillates at a frequency of about 20 pulses/-second; but by changing the parameters of the device, and particularly by increasing the inlet pressure, this frequency can be increased to hundreds and even to thousands of pulses per second.

Figure 3:
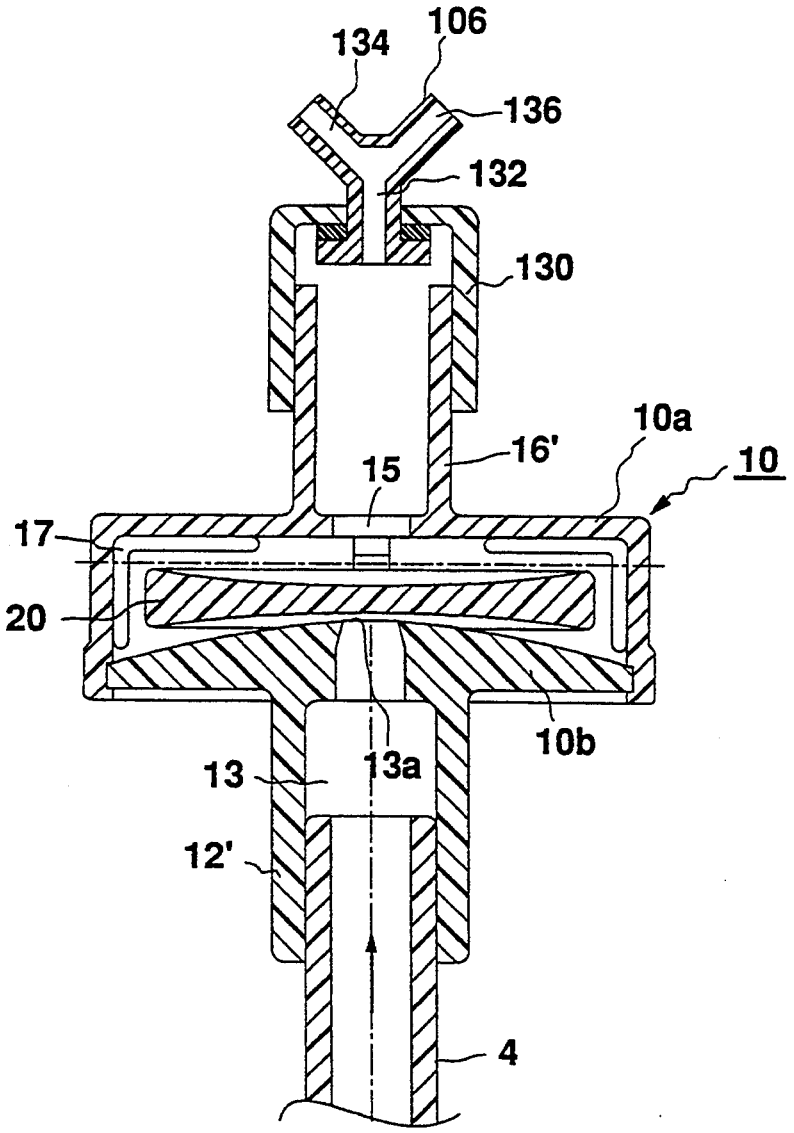
FIG. 3 illustrates a modification in the construction of the pulsator of FIG. 1 as used with another type of water sprinkler.

FIG. 3 illustrates a pulsator of substantially the same construction as in FIGS. 1 and 2 but combined with a different type of sprinkler, therein designated 106. The construction and operation of the pulsator 10 in FIG. 3 are substantially the same as described with respect to FIGS. 1 and 2, and therefore similar parts have been correspondingly numbered. In FIG. 3, however, the inlet tubular connector, shown at 12', is of the female type, rather than the male type, to receive the supply line 4; and the outlet tubular connector 16' is of the male type, rather than of the female type, to receive a female connector of the sprinkler 106. The sprinkler 106 is of the rotary type, being formed with an inlet passage 132 for receiving the water pulsations from the pulsator 10 and for directing them to a pair of outlet openings 134, 136 to rotate the sprinkler and to distribute the water laterally of the sprinkler.

The pulsator described above is shown as being used with rotary sprinklers since it produces the above-described advantages which are particularly important when used in this application. However, it will be appreciated that the pulsator can be used in many other applications, including showerheads, nebulizers, and the like. Many other variations, modifications and applications of the invention will be apparent.

What is claimed is:

1. A fluid-flow control device, comprising:

a housing having an inlet opening extending through an inner face of the housing and connectible to a source of pressurized fluid, and an outlet opening extending from an inner face of the housing for discharging the fluid from the housing;

an oscillating member freely movable within said housing and having one face movable into and out of contact with said inner face of the housing through which said inlet opening extends to close and open said inlet opening;

said contacting faces of the oscillating member and housing being configured such as to set the oscillating member into rapid oscillation opening and closing the inlet opening when the inlet opening is connected to a source of pressurized fluid;

and spacing means spacing the oscillating member from the inner face of the housing formed with said outlet opening so as to prevent the oscillating member from closing the outlet opening;

characterized in that said outlet opening is formed in the opposite side of the housing, in axial alignment with said inlet opening, and is cooperable with said opposite face of the oscillating member such that the rapid oscillations of said oscillating member drive the fluid out of said outlet opening in the form of high-frequency pulses.

2. The device according to claim 1, wherein said contacting faces of the oscillating member and housing diverge away from each other radially outwardly of said inlet opening.

3. The device according to claim 2, wherein said inner face of the housing formed with said inlet opening is convex, and said face of the oscillating member contacting said inner face of the housing is concave and has a radius of curvature slightly larger than that of said convex surface of the housing, to thereby produce said diverging contacting faces.

4. The device according to claim 3, wherein said spacing means comprises spacing ribs on the inner face of said housing formed with said outlet opening.

5. The device according to claim 3, wherein said housing includes further spacing ribs engageable with the outer periphery of said oscillating member to provide continuous fluid communication between the opposite sides of said oscillating member.

6. The device according to claim 5, wherein said oscillating member is in the form of a disc having an outer diameter slightly less than the inner diameter of said housing.

7. The device according to claim 6, wherein said opposite face of the oscillating disc is also concave.

8. The device according to any one of claims 1–7, wherein said inlet opening is of smaller cross-sectional area than said outlet opening.

9. The device according to claim 1, wherein said housing includes a first section formed with said inlet opening, and a second section formed with said axially-aligned outlet opening attached to said first section.

10. The device according to claim 9, wherein said first section is integrally formed with a tubular coupling for coupling same to a source of pressurized fluid, and said second section is integrally formed with a tubular coupling for coupling same to a utilization device receiving said high-frequency pulses discharged from said outlet opening.

11. A fluid-flow control device, comprising:

a housing having an inlet opening extending through an inner face of the housing and connectible to a source of pressurized fluid, and an outlet opening extending from an inner face of the housing for discharging the fluid from the housing;

an imperforate oscillating member freely movable within said housing and having one face movable into and out of contact with said inner face of the housing through which said inlet opening extends to close and open said inlet opening;

said contacting faces of the oscillating member and housing being configured to diverge away from each other radially outwardly of said inlet opening such as to set the oscillating member into rapid oscillation opening and closing the inlet opening when the inlet opening is connected to a source of pressurized fluid;

and spacing means spacing the oscillating member from the inner face of the housing formed with said outlet opening so as to prevent the oscillating member from closing the outlet opening;

said outlet opening being formed in the opposite side of the housing, in axial alignment with said inlet opening, and being cooperable with said opposite face of the oscillating member such that the rapid oscillations of said oscillating member drive the fluid out of said outlet opening in the form of high-frequency pulses.

12. The device according to claim 11, wherein said inner face of the housing formed with said inlet opening is convex, and said face of the oscillating member contacting said inner face of the housing is concave and has a radius of curvature slightly larger than that of said convex surface of the housing, to thereby produce said diverging contacting faces.

13. The device according to claim 12, wherein said spacing means comprises spacing ribs on the inner face of said housing formed with said outlet opening.

14. The device according to claim 13, wherein said housing includes further spacing ribs engageable with the outer periphery of said oscillating member to provide continuous fluid communication between the opposite sides of said oscillating member.

15. The device according to claim 14, wherein said oscillating member is in the form of a disc having an outer diameter slightly less than the inner diameter of said housing, said opposite face of the oscillating disc also being concave.

16. The device according to claim 1, in combination with a water utilization device connected to said outlet opening, said utilization device having an inlet of smaller cross-sectional area than that of said outlet opening in the fluid-flow control device.

17. The combination according to claim 16, wherein said housing is integrally formed with a tubular coupling through which said outlet opening extends, and said utilization device is formed with a tubular coupling coupled to said tubular coupling of the housing.

18. The combination according to claim 16, wherein said housing includes a first section integrally formed with a tubular coupling through which said inlet opening extends for coupling to a source of pressurized fluid, and a second section integrally formed with a tubular coupling through which said outlet opening extends for coupling to said a utilization device to receive said high-frequency pulses discharged from said outlet opening.

19. The combination according to claim 16, wherein said utilization device is a rotary sprinkler.

* * * * *